United States Patent [19]

Blair et al.

[11] 4,375,140

[45] Mar. 1, 1983

[54] DOOR OPENER FOR BUS AND THE LIKE

[75] Inventors: William F. Blair, Midlothian; Patrick Downey, Fort Worth, both of Tex.

[73] Assignee: Excell Machine Company, Inc., Mansfield, Tex.

[21] Appl. No.: 256,773

[22] Filed: Apr. 23, 1981

[51] Int. Cl.[3] ..... E05C 7/06

[52] U.S. Cl. ..... 49/108; 49/110; 49/141

[58] Field of Search ..... 49/109, 110, 111, 139, 49/141, 107, 108

[56] References Cited

U.S. PATENT DOCUMENTS

| | | | |
|---|---|---|---|
| 1,806,203 | 5/1931 | Huston | 49/108 X |
| 2,173,475 | 9/1939 | Forman | 49/141 |
| 2,789,813 | 4/1957 | Runkle | 49/141 X |
| 2,893,506 | 7/1959 | Daugirdas | 49/110 X |
| 3,793,773 | 2/1974 | Sheckells | 49/141 X |

*Primary Examiner*—Kenneth Downey

*Attorney, Agent, or Firm*—Wofford, Fails & Zobal

[57] ABSTRACT

What is disclosed is a door opener for a bus and the like having a pair of doors pivotally mounted on each side of a door opening on respective door shafts characterized by respective door bell cranks connected with the door shaft so as to effect desired rotation thereof; a central bell crank journalled for pivotal movement for opening the doors; and a pair of respective linking arms connected respectively with the central bell crank and with respective door bell cranks, at least one of the linking arms including respective telescoping members and biasing means for maintaining a noise-abating force on the doors; motor and interconnection mechanism for effecting controlled pivotal rotation of the central bell crank for opening the doors and for closing the doors and a safety override for disengaging the motor to allow the doors to be opened manually in the event of an emergency. Also disclosed is the respective preferred embodiment.

6 Claims, 4 Drawing Figures

DOOR OPENER FOR BUS AND THE LIKE

FIELD OF THE INVENTION

This invention relates to door openers for buses and the like. More particularly, it relates to door openers for buses having a pair of doors disposed on respective door shafts on each side of a door opening for being pivoted opened and closed as desired by an operator responsive to an operators switch at the control position.

DESCRIPTION OF THE PRIOR ART

A wide variety of door openers have been known in the prior art. More specifically, a wide variety of door openers for buses and the like have been known in the prior art. Door openers for the rear doors on buses have been particularly troublesome in the past because of the noisy character of the doors which have normally been two small doors disposed on each side of the opening so as to take up less lateral space when opened exteriorly of the bus to allow egress of the passengers. The front entrance door has not posed any problem since it can be opened by the driver with relative ease. Early art included mechanical linkages but this proved cumbersome and noisy. Thereafter, cables were tried over pulleys to open the doors but this proved less than satisfactory. Subsequently even hydraulic and pneumatic openers were tried but again were risky because of the force of the opening and closing. More recently, the buses have simply employed spring biased doors with latches to hold them closed, but that can be pushed open when the latch is released. The latches were electronically released, as with an electric solenoid or the like, to allow the passengers to push the doors open.

Accordingly, it can be seen that though a wide variety of prior art has been tried, no satisfactory method has been available to open the doors with a force that is not harmful yet is satisfactory and to effect closure of the doors as desired without having to rely upon spring closing of the doors, the period of opening and closing of the door being entirely under the control of the operator of the bus.

SUMMARY OF THE INVENTION

Accordingly, it is an object of this invention to provide a door opener for opening and closing doors under the control of and as desired by an operator of the vehicle on which the doors are mounted.

More particularly, it is an object of this invention to provide a door opener for opening the rear doors on a bus to allow them to be opened and remain opened as desired by an operator of the bus to allow ingress or egress of passengers and the like; yet obviate the disadvantages of the prior art door openers.

These and other objects will become apparent from the descriptive matter hereinafter, particularly when taken in conjunction with the appended drawings.

In accordance with this invention there is provided a door opener for buses or the like having a pair or doors pivotally mounted on respective door shafts on each side of a door opening for being pivoted open and closed as desired, characterized by;

a. respective door bell cranks connected with the door shafts so as to effect the desired pivotal rotation thereof;

b. a central bell crank journalled for pivotal movement for opening the doors and having double throw arms, one for each door;

c. a pair of respective linking arms connecting respectively the central bell crank with a respective door bell crank; at least one of the linking arms including a pair of telescopingly mounted members for effecting reciprocal movement of one member with respect to the other member and a biasing means for maintaining a noise-abating force on the doors;

d. motor means and interconnecting means for effecting controlled pivotal rotation of the central bell crank; and e. a safety override adapted to disengage the motor means and a part of the interconnection means for allowing the doors to be opened manually in the event of an emergency.

DESCRIPTION OF THE PREFERRED EMBODIMENTS

It should be borne in mind that this invention may be useful in any application in which there are a pair of opposed doors mounted on door shafts on each side of the doorway opening. In the embodiment herein, however, it will be described with respect to opening the dual rear doors on the back of a bus allowing egress of passengers responsive to operation of a directional switch on the operators control console (not shown). The operator switch is ordinarily an electrical switch with connections to the motor which is directionally driven responsive to the direction the switch is moved. This type of switch and control is well known and need not be described or shown herein.

Figure 1:
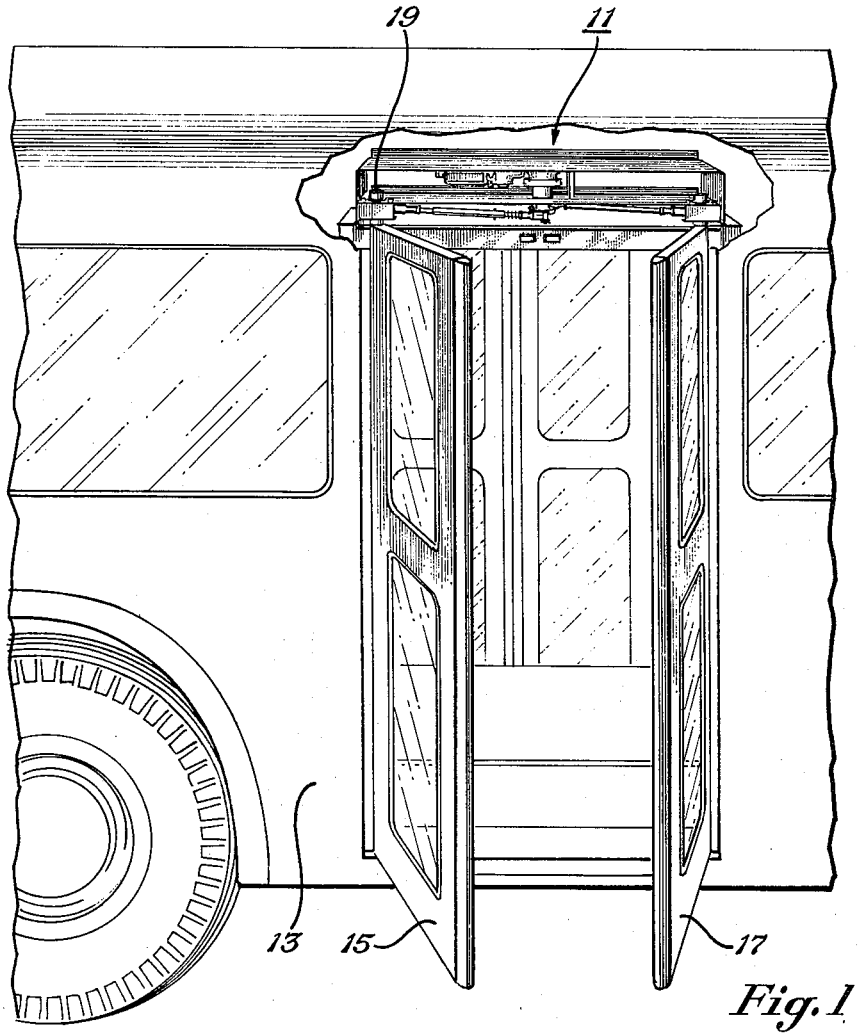
FIG. 1 is a partial perspective view, partly cut away, showing one embodiment of this invention mounted on a bus.
Figure 2:
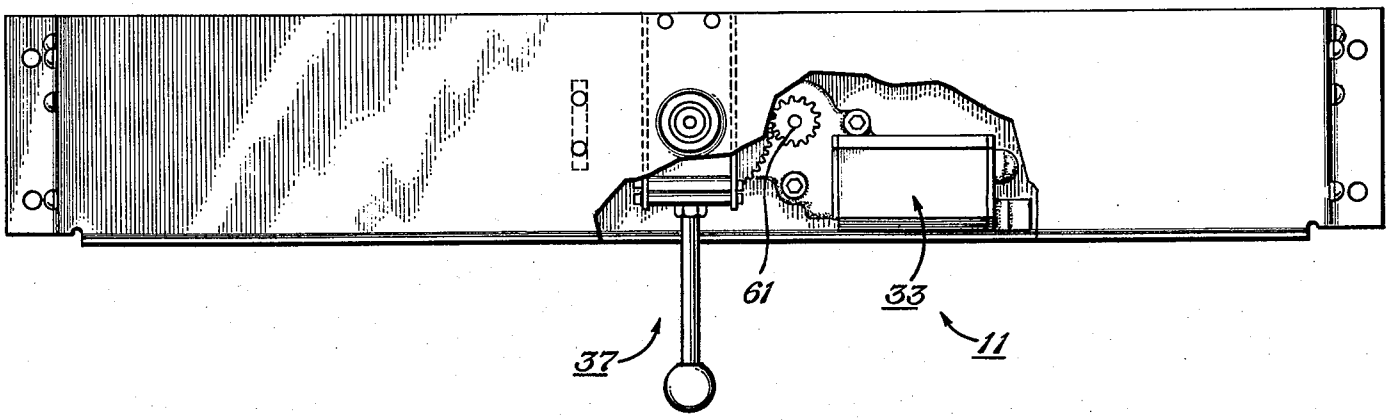
FIG. 2 is a top plan view of the door opener of this invention.
Figure 3:
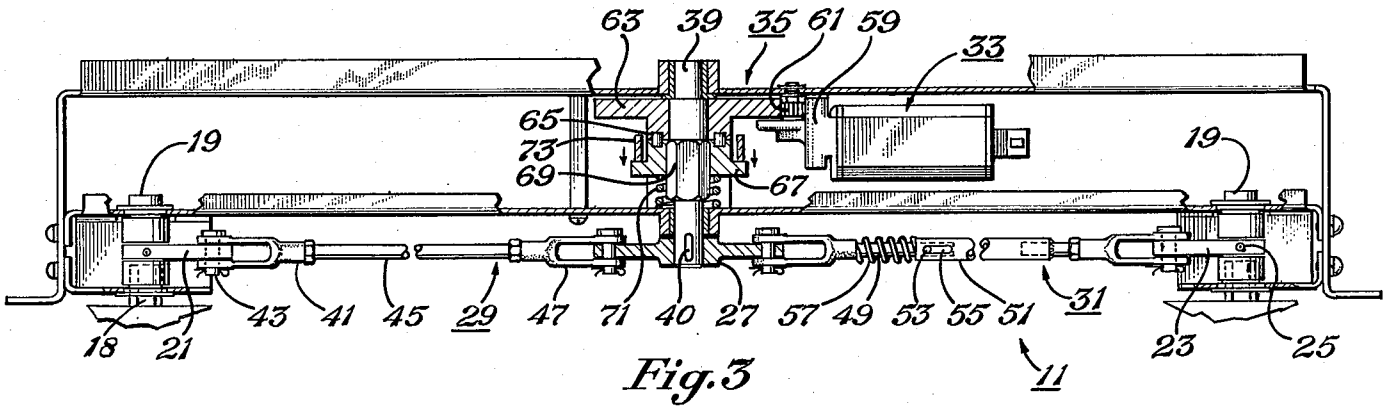
FIG. 3 is a partial cross sectional view, partly cut away, of the door opener of FIG. 2 with the safety override removed for clarity.

Referring to the Figs. and particularly FIGS. 1–4, the door opener 11 is shown installed on a bus 13, FIG. 1. The bus 13 has a pair of doors 15, 17 pivotally mounted on respective door shafts 18 on each side of the door opening for being pivoted open and closed as desired for permitting, for example, egress of passengers. As illustrated, the door shafts 18 are shown in FIG. 3 as hexagonal stub shafts that are inserted within respective sockets in the bottom end of shafts 19. The shafts 19 are, inturn, connected to respective door bell cranks 21, 23 as by spring pin 25, so as to rotate in unison therewith. Other connections can be employed as desired to effect the desired opening of the doors responsive to pivotal rotation of the door bell cranks effected by pivot rotation of a central bell crank.

The door opener 11 also includes a central bell crank 27, FIG. 3; a pair of respective linking arms 29, 31; motor means 33 and interconnection means 35 for effecting control pivotal rotation of the central bell crank 27, and a safety override 37, FIG. 2.

The central bell crank 27 is journalled for pivotal movement for opening the doors. The central bell crank 27 has double throw arms, one for each door so as to operate the respective door bell cranks 21, 23, through their angles of rotation for effecting opening of the respective doors.

As is recognized, the doors 15, 17 may comprise any of the typical doors for transportation vehicles or the like. On the other hand, they can comprise any of the typical doors for vehicles that need to be opened at the control of an operator. Ordinarily, they are relatively light weight so as to be opened outwardly by manual pressure when released from the motor means and interconnection means as discussed hereinafter with respect to the safety override.

The bell cranks are preferably formed of a structurally strong material such as steel, aluminum, magnesium or the like to effect opening of the doors. Because of its ease in working, economics and the like, steel is ordinarily preferred.

The central bell crank 27 is connected with the central shaft 39, FIG. 3 by way of suitable key way slot and key 40 so as to rotate in unison therewith.

The respective linking arms 29 and 31 connect the respective door bell cranks with the respective throws of the central bell crank 27. As illustrated, the interconnection is by way of apertured throws and bifurcated yokes 41 and cotter keyed pin shafts 43. The interior link 45 of the linking arms 29, 31 are threadedly received at each end in respective threaded ends of the yokes and have respective lock nuts 47 to lock them into position when the desired length has been achieved for the linking arm. The respective ends and engaging yokes have respective left-hand and right-hand threads such that rotation in a given direction effects obtaining a desired length, lengthening when rotated in one direction and shortening when rotated in another direction.

At least one of the linking arms includes a pair of telescopingly mounted members and biasing means for maintaining a noise-abating force on the doors. As illustrated, the telescoping members include a central member 49 that is slidably received within an outer tubular member 51. The central member has a laterally protruding pin 53. The pin 53 is slidably encompassed within the slot 55 of the outer tubular member. The slot 55 limits the longitudinal extent of the movement of the pin 53. A biasing means comprising spring 57 is employed to force the members apart and hence impose a force on the doors that minimizes their rattling and the like.

The motor means 33 comprises an electric motor operated off the vehicle electrical system; for example, a twelve volt electrical system. Any of the conventional motors that will develop adequate torque and are properly sized can be employed. The electric motors are particularly advantageous and the prior art has failed to provide satisfactory electrically driven door openers.

Interconnection means 35 includes a gear reducer 37 employing a series of worm gears and circular gears. The gear reducer 59 has a small circular gear 61 that engages a central circular pinion 63.

In this invention a commercially available motor 33, gear reducer 37 and gear 61 are employed. The commercially available unit is obtained from General Motors. Consequently, its detailed description need not be contained herein.

The central circular pinion 63 is free to rotate with respect to the shaft 39 except as otherwise restricted in its pivotal movement. Its pivotal movement is othewise restricted by dowels 65 that are normally engaged in recesses in the circular pinion 63. The dowels 63 are also engaged in recessed in an idler 67. The idler 67 has an aperture in its center that conformingly engages a similarly shaped section of the shaft 39 so as to rotate in unison therewith. As illustrated, the aperture in the center of the idler 67 is hexagonal and the shaft 39 has a hexagonal section 69 that conformingly engages the aperture in the idler 67. Of course any other shape such as square, octagonal, splined and the like can be employed if desired.

The idler 67 is biased upwardly in FIG. 3 to engage the dowels 65 in their respective recesses so as to move in unison with the central circular pinion 63 and the shaft 39 in normal operation. A spring 71 effects this upward biasing.

Limit switches, either mechanical or photo-cell type, can be employed as desired.

Figure 4:
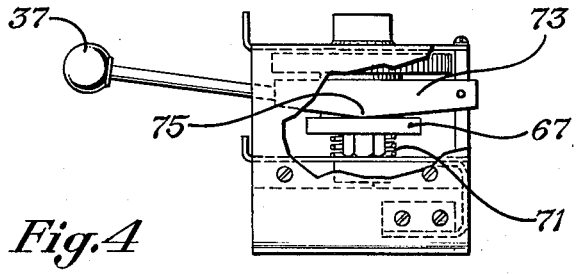
FIG. 4 is a side elevational view of the safety override of FIG. 2.

When, as in an emergency or the like, it is desired to override the electric motor means and the interconnection means 35, the safety override lever 37, FIG. 4, is pulled downwardly. Its cam 73 pushes downwardly on the idler 67 against the spring 71 and frees the dowels 65 from engagement with their recesses in either the upper surface of the idler 67 or the bottom of the pinion 63. Consequently, the idler is free to rotate and allow the doors to be pushed open manually without rotating the circular pinion 63.

In operation, the door opener is installed as illustrated and described hereinbefore. The electrical interconnection is made with the operator's control switch (not shown). The operator moves the switch to the open position. This effects rotation of the motor means 33 and the circular gear 61. This effects pivotal movement of the central bell crank 27 by way of the circular pinion 63 and the engaged idler 67 and pivotal movement of the shaft 39. Through this movement, the respective central bell crank throw arms effect pivotal movement of the bell crank at each door and pivotal movement of the door shafts 19, opening the doors 15, 17. Conversely, when the operator moves the switch to the closed position electric motor 33 operates in the opposite direction effecting reversal of the pivotal movements and closing the doors 15, 17.

As implied hereinbefore, when emergency operation is necessary or the safety override is employed, the idler 67 is moved downwardly by a pair of arms 73, FIGS. 3 and 4, to free the idler 67 and allow the doors to be opened manually without having to move them against the backward force of the gear reducer 59 and the motor means 33.

From the foregoing it can be seen that this invention achieves the objects delineated hereinbefore.

Although the invention has been described with a certain degree of particularity, it is understood that the present disclosure is made only by way of example and that numerous changes in the details of construction and the combination and arrangement of parts may be resorted to without departing from the spirit and the scope of the invention, reference for the latter purpose being had to the appended claims.

We claim:

1. A door opener for a bus or the like having a pair of doors pivotally mounted on respective door shafts on each side of a door opening for being pivoted opened and closed as desired, comprising:

a. respective door bell cranks connected with the respective door shafts so as to effect the desired rotation thereof so to open and close the doors, respectively;

b. a central bell crank journalled for pivotal movement for respectively opening and closing the doors and having double throw arms, one for each door;

c. a pair of respective linking arms connecting respectively said central bell crank with a respective door bell crank; at least one of said linking arms including a pair of telescopingly engaging members for effecting reciprocal movement of one with respect to the other and a biasing means for maintaining a noise-abating force on the doors;

d. motor means and interconnection means for effecting controlled pivotal rotation of said central bell crank; and e. a safety override mounted adjacent said central bell crank and adapted to override and disengage said motor means and said interconnection means to allow manual opening of said doors in the event of an emergency.

2. The door opener of claim 1 wherein said motor means comprises an electric motor and said interconnection means includes a central circular pinion and a gear reducer and gear connected with said circular pinion; said circular pinion being connected with said central bell crank so as to rotate in unison therewith.

3. The door opener of claim 2 wherein said central pinion is mounted on a shaft so as to rotate freely with respect to said shaft and to allow said shaft to rotate freely with respect to said circular pinion in the absence of other restrictions said circular pinion is dowelled by way of releasable dowels to a central idler; said central idler having a multiple faceted aperture for engaging a multiple faceted portion of the said shaft; said shaft has a multiple faceted portion that conformingly engages said idler so as to effect rotation in unison thereof; said idler being forced towards said circular pinion by way of a biasing means such that rotation of said circular pinion effects roatation of said idler and, consequently, said shaft; said shaft being connected with said central bell crank by suitable interconnections so as to rotate in unison therewith.

4. The door opener of claim 3 wherein said shaft is journalled in a fixed framework about the door opening and is journalled for rotation responsive to either a force on the doors that tends to rotate said central bell crank or a force on said idler that tends to rotate said shaft and hence said bell crank; said safety override includes a lever that is pivotally mounted and has a cam means for forcing said idler away from said central circular pinion to allow it to rotate freely such that said doors can be forced open manually after disengagement from said central circular pinion and hence said motor means.

5. The door opener of claim 2 wherein said safety override includes a lever with a cam means for effecting disengagement of said motor means and part of said interconnection means for allowing said doors to be forced open manually if there is an emergency.

6. The door opener of claim 1 wherein said telescoping members include a central member slidably received within an outer tubular member, said central member having a laterally extending and protruding end, said outer telescoping member having a slot encompassing said pin and limiting its travel; and said biasing means includes a spring disposed about said central member.

* * * * *